US007789689B2

(12) United States Patent
Frey et al.

(10) Patent No.: US 7,789,689 B2
(45) Date of Patent: Sep. 7, 2010

(54) POTHEAD FOR USE IN HIGHLY SEVERE CONDITIONS

(75) Inventors: Jeffrey G Frey, Broken Arrow, OK (US); Terry L Glasscock, Vinita, OK (US); Frank Warren Eddings, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/429,320

(22) Filed: Apr. 24, 2009

(65) Prior Publication Data

US 2009/0269956 A1 Oct. 29, 2009

Related U.S. Application Data

(60) Provisional application No. 61/047,469, filed on Apr. 24, 2008.

(51) Int. Cl.
*H01R 13/52* (2006.01)

(52) U.S. Cl. ..... 439/275; 439/279

(58) Field of Classification Search ..... 439/274, 439/275, 279, 589

See application file for complete search history.

(56) References Cited

U.S. PATENT DOCUMENTS 3,567,843 A * 3/1971 Collins et al. ..... 174/51
3,573,210 A 3/1971 Furusawa et al.
3,649,542 A 3/1972 Hasebe et al.
3,764,959 A * 10/1973 Toma et al. ..... 439/584
3,833,754 A * 9/1974 Philibert ..... 174/653
3,923,676 A 12/1975 Rasanen
3,952,218 A 4/1976 Deters
3,980,369 A 9/1976 Panek
3,997,232 A * 12/1976 Dunaway ..... 310/68 R
4,030,741 A * 6/1977 Fidrych ..... 285/149.1
4,053,196 A 10/1977 Dunaway
4,104,481 A 8/1978 Wilkenloh et al.
4,128,735 A 12/1978 Zehren
4,193,657 A * 3/1980 Slone ..... 439/598
4,447,104 A * 5/1984 Haggard ..... 439/449
4,456,844 A 6/1984 Yamamoto et al.
4,500,263 A 2/1985 Mohn
4,547,623 A * 10/1985 Van Brunt et al. ..... 174/359
4,549,755 A * 10/1985 Kot et al. ..... 285/341
4,667,737 A 5/1987 Shaw et al.
4,679,875 A 7/1987 Ramsey
4,885,429 A * 12/1989 Schnittker ..... 174/668
5,104,340 A * 4/1992 Elam et al. ..... 439/604

(Continued)

FOREIGN PATENT DOCUMENTS

EP 0880147 A1 11/1998

(Continued)

*Primary Examiner*—Ross N Gushi
(74) *Attorney, Agent, or Firm*—Bracewell & Giuliani LLP

(57) ABSTRACT

A pothead assembly for use under severe operating conditions. The pothead assembly includes a plurality of ferrules, a compression plate, a pothead housing, and a threaded collar. When the collar and a base portion of a pothead housing are engaged, the pothead assembly is operable to form a metal to metal seal on metal tubing that surrounds insulated wiring without the use of a solder joint or weld joint. The resulting pothead assembly has a lower profile than conventional potheads, does not require the use of tube connectors and is operable to form the seal in close proximity to the motor.

20 Claims, 5 Drawing Sheets

U.S. PATENT DOCUMENTS 5,113,101 A * 5/1992 Liu et al. ..... 310/87
5,191,173 A 3/1993 Sizer et al.
5,208,427 A * 5/1993 Couto et al. ..... 174/653
5,246,783 A 9/1993 Spenadel et al.
5,310,963 A * 5/1994 Kennelly ..... 174/667
5,338,213 A 8/1994 Oko
5,459,286 A 10/1995 Bergman et al.
5,478,970 A * 12/1995 Lawler et al. ..... 174/74 R
5,567,170 A 10/1996 Kroeber
5,567,174 A * 10/1996 Ericson et al. ..... 439/462
5,670,747 A * 9/1997 Lawer et al. ..... 174/74 R
5,700,161 A 12/1997 Plummer et al.
5,823,256 A * 10/1998 Moore ..... 166/65.1
6,179,585 B1 1/2001 Kobylinski et al.
6,202,743 B1 3/2001 Moore
6,298,917 B1 10/2001 Kobylinski et al.
6,361,342 B1 3/2002 Cox
6,409,485 B1 6/2002 Ebner
6,443,780 B2 * 9/2002 Wilbourn et al. ..... 439/738
6,455,769 B1 9/2002 Belli et al.
6,600,108 B1 7/2003 Mydur et al.
6,676,447 B1 * 1/2004 Knox ..... 439/587
6,695,062 B2 2/2004 Dalrymple et al.
6,910,870 B2 6/2005 Ebner
6,918,788 B2 7/2005 Cavanaugh
6,924,436 B2 8/2005 Varkey et al.
7,150,325 B2 12/2006 Ireland et al.
7,264,494 B2 * 9/2007 Kennedy et al. ..... 439/274
7,288,721 B2 10/2007 Varkey et al.
7,325,596 B2 * 2/2008 Ebner ..... 166/65.1
7,414,202 B2 8/2008 Lee et al.
7,575,458 B2 * 8/2009 Parmeter et al. ..... 439/271
7,611,339 B2 * 11/2009 Tetzlaff et al. ..... 417/422
7,632,124 B2 * 12/2009 Kennedy et al. ..... 439/274
7,666,013 B1 * 2/2010 Kopecky et al. ..... 439/191
2002/0013093 A1 * 1/2002 Wilbourn et al. ..... 439/625
2004/0014359 A1 * 1/2004 Knox ..... 439/587
2004/0120837 A1 6/2004 Ebner
2006/0065429 A1 3/2006 Kim et al.
2006/0137898 A1 6/2006 Kim et al.
2006/0213665 A1 9/2006 Ebner
2007/0046115 A1 * 3/2007 Tetzlaff et al. ..... 310/71
2007/0235195 A1 10/2007 Lawson
2008/0064269 A1 * 3/2008 Parmeter et al. ..... 439/733.1
2009/0258522 A1 * 10/2009 Bracci et al. ..... 439/279
2009/0269956 A1 * 10/2009 Frey et al. ..... 439/275

FOREIGN PATENT DOCUMENTS

GB 2361352 A 10/2001

* cited by examiner

POTHEAD FOR USE IN HIGHLY SEVERE CONDITIONS

RELATED APPLICATIONS

This patent application claims priority to U.S. Provisional Patent Application Ser. No. 61/047,469 filed on Apr. 24, 2008, which is incorporated by reference in its entirety.

FIELD OF THE INVENTION

This invention relates in general to a subterranean connector for use in a wellbore. More particularly, the present invention is directed to a high temperature pothead connector used to provide power to a submersible motor. Yet more particularly, the present invention provides a pothead connector that is capable of withstanding extreme conditions, such as high temperatures and pressures, as well as highly corrosive environments.

BACKGROUND

A common type of electrical submersible pump comprises a centrifugal pump suspended on a string of tubing within a casing of the well. The pump is driven by a downhole electrical motor, normally a three-phase AC type. A power line extends from a power source at the surface alongside the tubing to the motor to supply power.

Typically the power line is made up of two sections, a motor lead and a power cable. The motor lead has a plug on its lower end that secures to a receptacle known as a "pothead" at the upper end of the electrical motor. The motor lead has three conductors that are insulated and located within a single elastomeric jacket that is extruded around the assembled insulated conductors. Metallic outer armor may wrap around the jacket of the motor lead to avoid damage to the motor lead while running the pump assembly into the well. The motor lead extends upward beyond the pump, for example from 10 to 80 ft. The total of the motor lead and pothead is known as the motor lead extension (MLE). The lead could exceed 80 ft or be shorter than 10 ft depending on the application. A splice connects the motor lead to the power cable. The motor lead is flat and smaller in dimension than the power cable so that it can pass between the pump assembly and the casing.

The power cable comprises three conductors, each having one or more layers of insulation. An elastomeric jacket is usually extruded over the assembled conductors. In some cases, the insulated conductors are encased in lead. The insulated conductors are arranged either in a flat side-by-side configuration, or in a round configuration spaced 120 degrees apart from each other relative to a longitudinal axis of the power cable. A metallic armor is typically wrapped around the jacket to form the exterior of the power cable.

In some wells, the formation temperature is quite hot. Also, the motor generates heat. At least one of the insulation layers of each conductor may be formed of a polymer that is resistant to high temperature degradation. However, current high temperature polymer materials may not be capable of withstanding the high temperatures and harsh environments in some wells. If the insulation degrades, a short could result that would require the pump assembly to be pulled and replaced. Conventional pothead designs that are capable of withstanding these extreme conditions are generally bulkier and have large profiles. However, there are some situations in which the target wells have size limitations that prevent the use of these conventional pothead designs. Therefore, it would be beneficial to have a pothead design that is operable to work in harsh conditions while maintaining a small profile.

SUMMARY OF THE INVENTION

The present invention is directed to a device and method that satisfies at least one of these needs. One embodiment of the present invention provides for a pothead assembly having a compression plate, a plurality of ferrules, a pothead housing and a single compression collar. The compression plate has a plurality of holes formed therethrough, with each hole adapted to receive a metal wire protector containing an insulated wire. Each ferrule surrounds one of the metal wire protectors and engages one of the holes of the compression plate. The pothead housing has a base portion, with the base portion having a plurality of passages formed therein that register with the holes in the compression plate, wherein each passage receives one of the insulated wires. The single compression collar is in operable engagement with the pothead housing and all of the ferrules. The compression plate is located between at least a portion of the compression collar and the base portion of the pothead housing such that advancing the compression collar toward the base portion compresses each ferrule such that each ferrule is operable to circumferentially engage and seal around one of the metal wire protectors. In one embodiment, the holes are located radially about the compression plate's centerpoint. In another embodiment, the assembly includes a plurality of insulated wires, wherein each insulated wire is contained within one of the metal wire protectors. In an additional embodiment, the compression plate has a lower face, and the base portion includes a backside face, wherein one of the faces is convex and the other face is concave. For example, if the lower face is concave, then the backside face would be convex. Advantageously, in some embodiments of the present invention, the ferrules can be compressed simultaneously.

In an additional embodiment of the present invention, the pothead assembly also includes a lower insulator, a plurality of female receptacles, a plurality of retaining sleeves, a retainer, a compression gasket, a boot and a terminal pin isolation seal that radially surrounds the prong receptacle insulators. The lower insulator includes a lower end and an upper end, with the upper end having a plurality of insulator passages formed therein and the lower end having a plurality of prong receptacle insulators. The insulator passages are aligned with the base passages. The female receptacles are partially disposed within the insulator passages, while the retaining sleeves are disposed within the insulator passages and abut the female receptacles. The retainer has a back portion that is operable to threadedly engage the pothead housing. The compression gasket contacts the pothead housing and is operable to expand radially outward once the pothead assembly is connected to a downhole electric motor. The boot radially surrounds the retainer and abuts the compression gasket and is operable to provide additional sealing protection.

In a further embodiment, the present invention can include a first and second alignment bore. The first alignment bore extends into the lower insulator from its back surface and the second alignment bore extends into the base portion's front surface. An indexing pin is disposed within the first and second alignment bores and is operable to properly align components within the pothead assembly. In another embodiment, the retainer is made from a non-conductive material, which can include polyetheretherketone. In yet another embodiment of the present invention, the retainer can include a recess on a front edge of the retainer. This recess is formed to cooperate with a tool, such as a spanner wrench, in order to apply the necessary torque to engage the retainer with the pothead housing.

In a further embodiment, the pothead assembly includes the compression plate, a plurality of conical ferrules, the pothead housing, and the compression collar. The compression plate includes a lower face and a plurality of holes formed therethrough, with each of the holes being operable to receive an insulated wire contained within a metal wire protector. The holes are spaced circumferentially about the compression plate's center. Each of the conical ferrules is operable to receive one of the metal wire protectors. The pothead housing has a lower end and an upper end, with the lower end having a flange that is operable to engage a downhole electric motor. The upper end includes a base portion and a backside face. Both the base portion and the backside face have a plurality of passages formed therethrough, with each of the passages being operable to receive one of the ferrules and one of the insulated wires. The compression collar has an axis and is engageable with the pothead housing, with the compression plate located therebetween. Each of the passages in the backside face has a conical portion that mates with one of the ferrules, such that when the compression collar is engaged with the upper end of the pothead housing, the compression collar exerts an axial force on the compression plate, causing the compression plate to exert an axial force on the ferrules, which in turn causes the ferrules to move inwardly into the conical portions of the passages of the backside face and deform circumferentially about the metal wire protectors to form a metal to metal seal. In one embodiment, the seal formed around each metal wire protector is done without the use of a weld joint.

In one embodiment, a portion of the inner periphery of the compression collar is threaded for engaging threads of the pothead housing, and an upper end of the compression collar includes an annular lip, the annular lip being operable to exert an axial force on the compression plate as the threads are tightened.

The present invention also includes a method for creating a metal to metal seal within a pothead without the use of a weld joint. In one embodiment of the present invention, the method includes inserting a plurality of metal wire protectors through a plurality of ferrules and through a plurality of passages of a pothead assembly and engaging a single compression collar with a pothead housing such that a compression plate exerts a compressive force on the ferrules against the pothead housing and simultaneously compresses all the ferrules about the metal wire protectors to form a metal to metal seal.

DETAILED DESCRIPTION OF THE INVENTION

Figure 1:
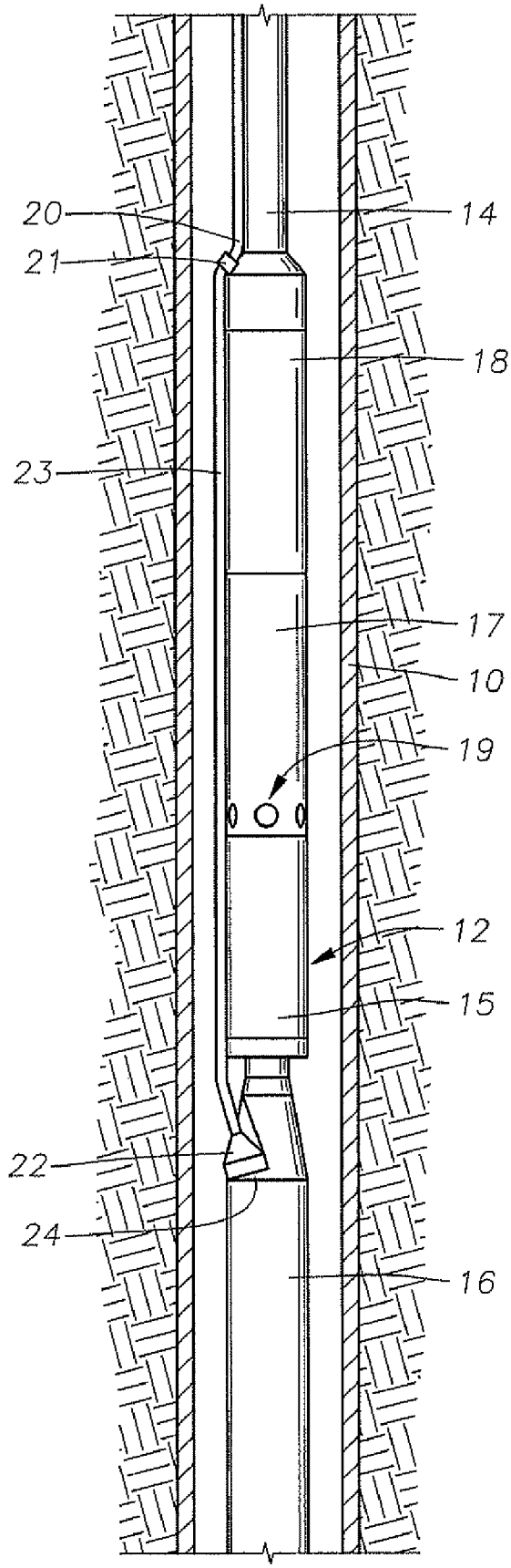
FIG. 1 is a side view of an electrical submersible pump disposed in a well.

FIG. 1 is an elevational section view of well [10] having electrical submersible pumping system (ESP) [12] disposed therein. ESP [12] includes an electric motor [16], a seal/equalizer section [15], an optional separator [17], and a pump [18]. Pump [18] may comprise a centrifugal pump or a progressing cavity pump. Fluid inlets [19] are shown provided on separator [17] for providing a passage for receiving fluid into ESP [12]. Production tubing [14] is coupled to pump [18] discharge for conveying pressurized production fluid from the ESP [12] to surface. Cable [20] extends downhole, terminating in a connector [21] that electrically couples cable [20] to a motor lead [23]. Motor lead [23], on its lower terminal end, connects to a pothead connector [22] that electrically connects and secures motor lead [23] to motor housing [24] of electric motor [16]. In another embodiment, cable [20] can extend all the way from the surface to pothead connector [22], thereby eliminating the need for connector [21].

Figure 2:
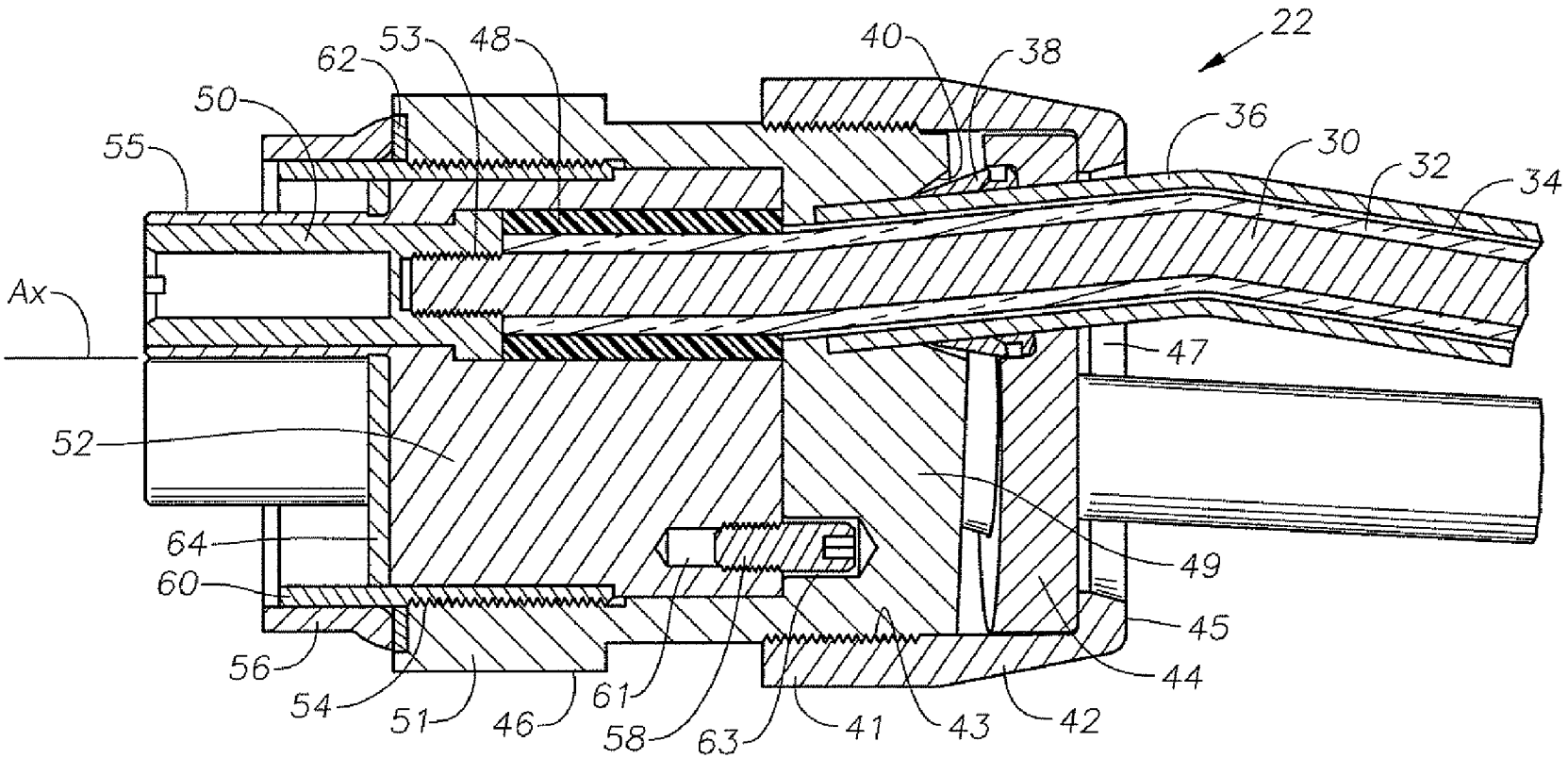
FIG. 2 is a longitudinal cross sectional view depicting the interior of an embodiment of a pothead connector in accordance with this invention.
Figure 4:
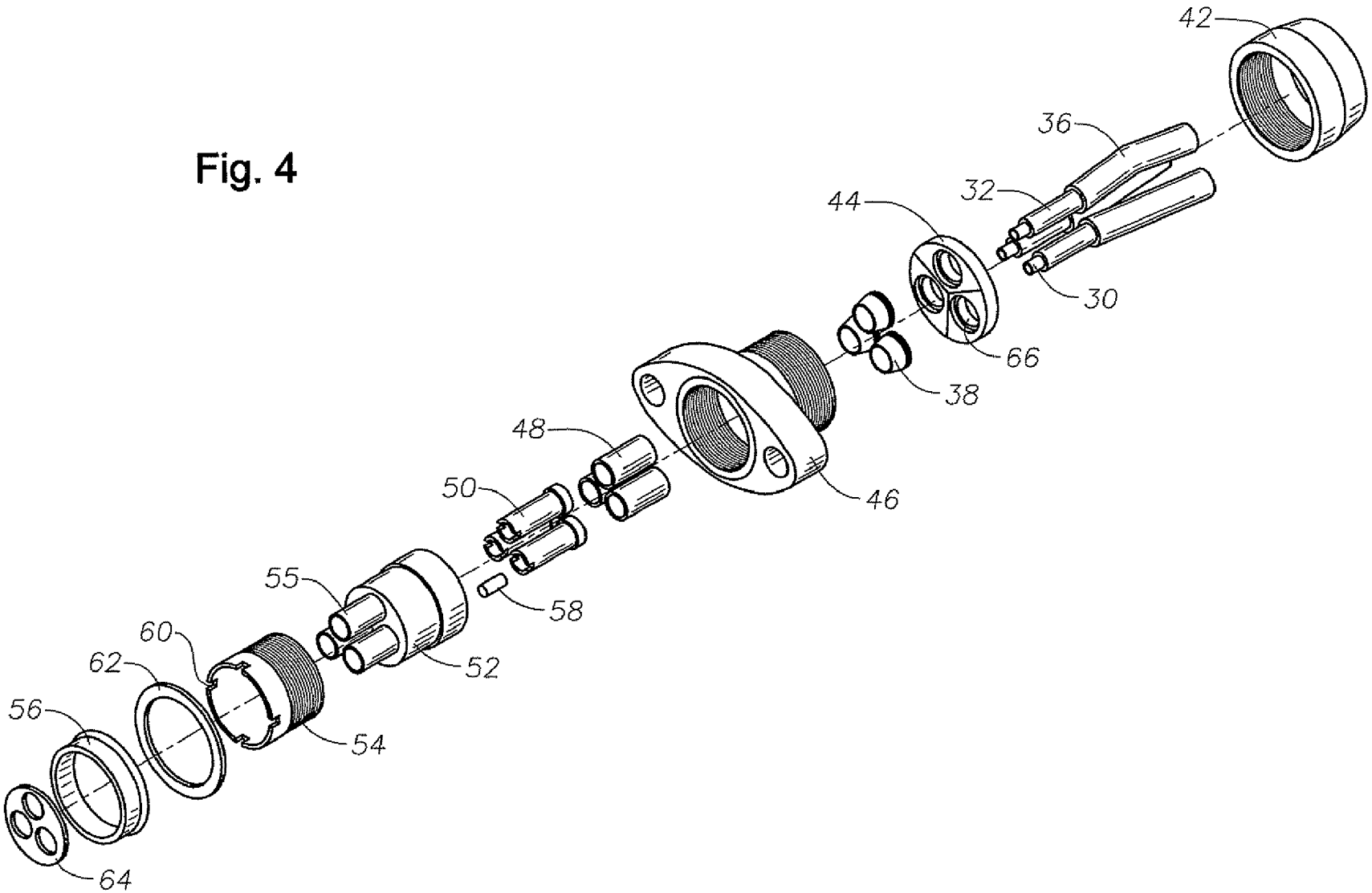
FIG. 4 is an exploded isometric view depicting an embodiment of a pothead connector in accordance with the present disclosure

FIG. 2 is a longitudinal cross section view depicting an embodiment of pothead connector [22] in accordance with the present disclosure. In the embodiment shown, pothead connector [22] comprises a compression collar [42], a compression plate [44], a female receptacle [50], a lower insulator [52], and a threaded retainer [54]. For clarity, FIG. 2 reflects a single wire [30], however, alternate pothead connector [22] embodiments may include two, three, or other numbers of wires as shown in FIG. 4. Wire [30] is made up of a conductive material, and provides an electrical pathway from surface equipment (not shown) to electric motor [16]. Each wire [30] is separately insulated by its own insulating layer [32]. Insulating layer [32] is made out of an insulating material, which in one embodiment comprises a polymeric material such as PFA, a copolymer of tetrafluorethylene and perfluoroalkoxy. In one embodiment, insulating layer [32] is radially surrounded by gap [34] thereby forming an annulus to allow for circulation of dielectric fluids. The dielectric fluids provide additional insulation protection to wire [30] as well as alleviate all air voids. A protective barrier of thin-walled tubing [36] surrounds each insulating layer [32] that protects insulating layer [32] and wire [30] from harsh elements within well [10]. In one embodiment, thin-walled tubing [36] extends the entire length of motor lead [23] (FIG. 1). In another embodiment, thin-walled tubing [36] can be a lead sheath.

Pothead connector [22] further includes compression collar [42] and compression plate [44]. In one embodiment, both compression collar [42] and compression plate [44] are made of high strength, corrosive resistant metallic material. As discussed in more detail below, compression plate [44] and compression collar [42] stabilize thin-walled tubing [36] (and thus wire [30]) within pothead connector [22]. As shown in FIG. 2, compression collar [42] comprises an annular skirt [41] shown generally coaxial with axis [$A_x$]. In one embodiment, threads [43] are formed on the inner periphery of annular skirt [41], with threads [43] being operable to engage threads on the outer periphery of base portion [49] of the pothead housing. Compression collar [42] also comprises an annular lip [45] at the upper terminal end of annular skirt [41]. Annular lip [45] is shown extending radially inward from annular skirt [41] generally perpendicular to axis [$A_X$]. Annular lip [45] terminates before reaching axis [$A_X$] thereby forming an opening [47] at the upper end of compression collar [42]. Compression plate [44] is disposed substantially parallel with annular lip [45], which protrudes radially inwardly so as to provide an axial force against compression plate [44].

Each thin-walled tubing [36] has its own ferrule [38]. Each ferrule is a conical metal sleeve, having a larger diameter on the upper side. In one embodiment, each ferrule [38] engages thin-walled tubing [36] by a compression force (e.g. crimping). In a farther embodiment, each ferrule [38] is crimped onto thin-walled tubing [36] with equal crimping force. Additionally, the ferrule/tube seating depth is equivalent for each ferrule. In another embodiment, each ferrule [38] sealingly engages and deforms thin-walled tubing [36] upon rotation of compression collar [42] onto pothead housing [46].

As shown, pothead housing [46] comprises base portion [49] formed to coaxially reside within annular skirt [41]. A housing skirt [51], which is generally annular, extends from base portion's [49] outer periphery towards the lower end of pothead connector [22]. In one embodiment, base portion [49] includes a backside face [57] (FIG. 3) having a plurality of base passages [59] (FIG. 3) formed therethrough to receive each wire [30] and its associated thin-walled tubing [36]. Passages [59] are formed to allow each wire [30] to extend therethrough and into the lower portion of pothead connector [22]. Optionally, each passage [59] diameter reduces at its lower end thereby forming a shoulder providing a stop for thin-walled tubing's [36] terminal end. Each passage [59] also includes an outwardly-directed transverse or conical chamfer [40] on its upper end. In one optional method of assembling pothead connector [22], each thin-walled tubing [36] is pulled through passages [59] in pothead housing [46] until ferrule [38] is seated in or otherwise contacts chamfer [40]. In one embodiment, pothead housing [46] is made of a non-permeable, corrosive resistant metallic material. In a more preferred embodiment, pothead housing [46] is made out of K500 Monel.

In one embodiment, compression plate [44] slides up against the back side of each ferrule [38], and compression collar [42] is slipped over compression plate [44]. Compression plate [44] has bore holes [66] (FIG. 4), which are used to align and contain each ferrule [38]. These bore holes [66] keep each ferrule [38] from expanding radially outward. Each bore hole [66] has a base that receives the upper end of one of the ferrules [38]. Compression collar [42] threads [43] are engaged with corresponding threads on the body of pothead housing [46] by application of an effective amount of torque. The application of torque on compression collar [42] results in pothead housing [46] and compression plate [44] applying a compressive force simultaneously on each ferrule [38]. Compression collar [42] rotates, however, compression plates [49] does not. This compressive action creates a fastening system within pothead connector [22], sealing all three thin-walled tubings [36] concurrently with a non-permeable, metallic seal while maintaining a low profile. By employing a metallic seal (rather than a seal using elastomeric material), pothead connector [22] is able to withstand highly corrosive conditions, particularly $H_2S$ gas, as well as conditions that have extreme operating temperatures and pressures.

Lower insulator [52] also includes passages aligned with the passages formed in base portion [49]. A portion of wire [30] and insulating layer [32] extend longitudinally past thin-walled tubing [36] within pothead housing [46] and into the passage of lower insulator [52]. A retaining sleeve [48] is provided in the lower insulator passage that radially surrounds insulating layer [32]. Preferably, retaining sleeve [48] is made of a non-conductive engineered thermoplastic. More preferably, retaining sleeve [48] is made of polyetheretherketone (PEEK). A portion of wire [30] further extends longitudinally past insulating layer [32]. The portion of wire [30] is not insulated and is threaded on its outer surface. In the embodiment shown, each female receptacle [50] has a generally tubular configuration and includes a wire connection [53] on its upper end and a prong receptacle insulator [55] on its lower end. A flange extends radially outward from the outer surface of wire connection [53] proximate to female receptacle [50] open end. Each, female receptacle [50] is disposed in pothead connector [22] with its wire connection [53] in the lower portion of lower insulator [52]. Threads are formed on the inner circumference of wire connection [53] so that wire [30] may be threadedly connected to female receptacle [50] via wire connection [53]. Lower insulator [52] is then pushed over each female receptacle [50] and retaining sleeve [48]. The lower insulator passage has a reduced diameter proximate to lower insulator [52] lower end that forms a shoulder mating with the flange. In a preferred embodiment, lower insulator [52] is made of a non-conductive engineered thermoplastic. In a more preferred embodiment, lower insulator [52] is made of PEEK.

The lower portion of lower insulator [52] has an outer diameter reduced from the upper portion, defining a shoulder on the insulator's outer surface where its outer diameter is reduced. An annular gap resides between the lower portion of lower insulator [52] and the inner diameter of housing skirt [51]. Threaded retainer [54], which is threaded on its outside periphery, is formed for insertion into the annular gap between lower insulator [52] and housing skirt [51] and threadedly connects with pothead housing [46]. Threaded retainer [54] has at least one recess [60] on its lower edge formed to cooperate with a spanner wrench to apply the necessary torque to connect threaded retainer [54] to pothead housing [46].

When threaded retainer [54] is connected within pothead housing [46], its upper terminal end engages the shoulder on lower insulator [52] thereby securing lower insulator [52] within pothead housing [46] and pothead connector [22]. Threaded retainer [54] helps to align and seal the non-conductive material of pothead connector [22]. A first alignment bore [61] is formed downward from the upper surface of lower insulator [52]. A second alignment bore [63] is formed upward from the lower surface of base portion [49]. In one embodiment, indexing pin [58] is disposed within the second alignment bore and during assembly lower insulator [52] is oriented to receive indexing pin [58] therein. Indexing pin [58] thus aligns and properly orients components within pothead connector [22]. A cylindrical ring or seal boot [56] radially surrounds threaded retainer [54] and is adjacent pothead housing [46]. The configuration as shown in FIG. 2 helps to increase the electrical integrity as the arc path distance is increased versus conventional designs. The present design achieves this result because no conductive material is present in the face of the pothead. In one embodiment, seal boot [56], threaded retainer [54], lower insulator [52], and prong receptacle [55] are formed of electrical insulation material; wherein female receptacles [50], indexing pin [58], pothead housing [46], compression plate [44], ferrules [38], wires [30], and thin-walled tubing [36] are formed from electrically conductive material.

Figure 3:
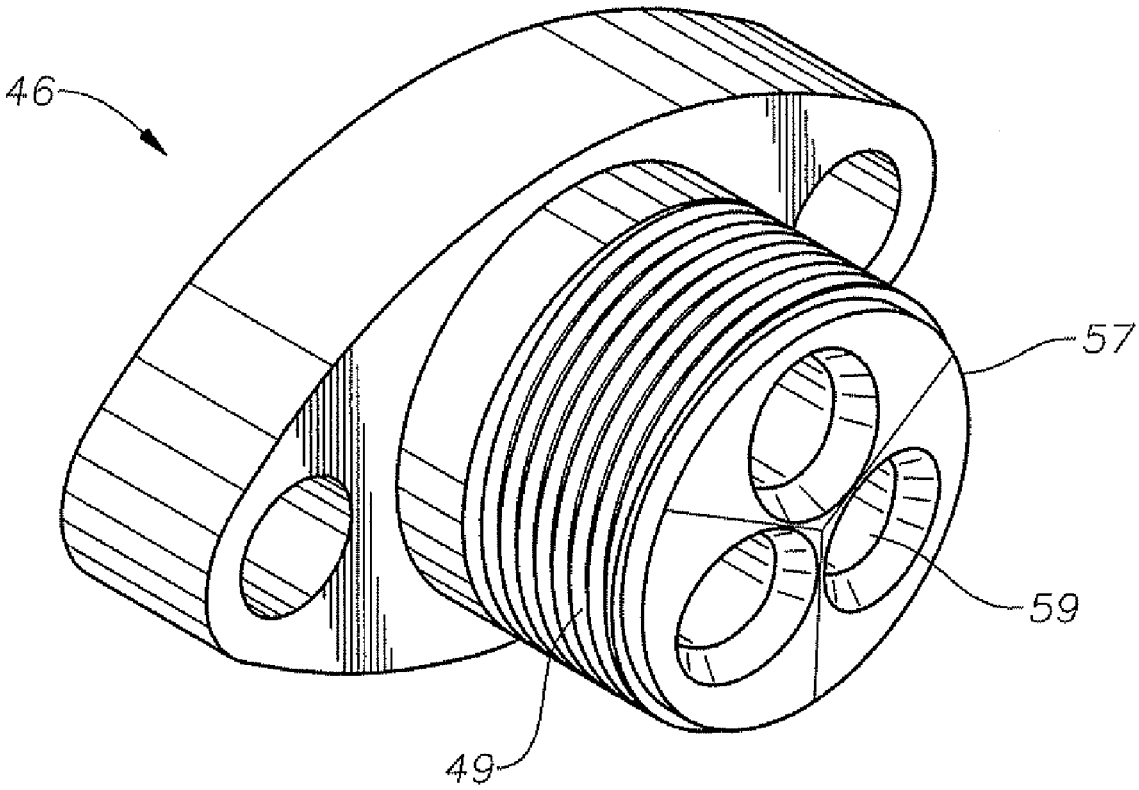
FIG. 3 is an isometric back view of the pothead housing.

FIG. 3 is an isometric view of the upper side of pothead housing [46]. As shown, pothead housing base portion [49] is cylindrically shaped. Base portion [49] also includes backside face [57], along with a plurality of base passages [59]. In one embodiment, backside face [57] is generally convex and shaped to be complimentary to the generally concave shaped compression plate [44] (FIG. 4). Backside face [57] provides the necessary opposing force to prevent ferrules [38] from moving downward into pothead housing [46] when the compression collar is engaged with pothead housing [46]. Included as generally concave or generally convex would include embodiments of the present invention wherein the backside face [57] has a plurality of surfaces, wherein the plurality of surfaces meet at the axial center of backside face [57], thereby forming a pyramidal structure.

FIG. 4 is an exploded isometric view of the embodiment shown in FIGS. 1-3 In a preferred embodiment, pothead connector is assembled in the following manner: each ferrule [38] is brought into contact with compression plate [44]. Wire [30], insulating layer [32] and thin-walled tubing [36] are then passed through bore holes [66], ferrules [38] and pothead housing [46], such that wire [30] and insulating layer [32] protrude axially through pothead housing [46]. Compression collar [42] is then threadedly connected to pothead housing [46] as described earlier, resulting in a radial force exerting pressure on thin-walled tubing [36], and ultimately providing a tight, solderless seal. Because the present invention does not require an external heat source to create the seal, there is no chance of burning insulating layer [32] of wire [30] during assembly. Furthermore, since wire [30] can be in place during assembly (as opposed to being pulled through thin-walled tubing [36] after sealing), the length of wire [30] used for the present invention is only limited by the requirements of the particular well, rather than by how much wire can be pulled through the tubing. Additionally, since the length of wire [30] of the present invention can be practically any length needed, the present invention does not require a separate barrier splice some distance away from pothead connector [22]. As such, the metal to metal seal formed in one embodiment of the present invention can be located in close proximity to the motor lead (e.g. within about a foot), thereby allowing the pothead assembly of the present invention to be quickly adapted for use in severe operating conditions without the need for additional soldering or welding. Retaining sleeve [48] slides over insulating layer [32], allowing wire [30] to axially protrude such that wire [30] may threadedly connect with female receptacle [50]. Indexing pin [58] connects with lower insulator [52], such that lower insulator [52] is in proper alignment when inserted into pothead housing [46]. Threaded retainer [54] is then threadedly connected with pothead housing [46], preferentially using a spanner wrench to apply torque on threaded retainer [54] via recess [60]. Compression gasket [62] radially surrounds threaded retainer [54], and is in contact with pothead housing [46]. Boot [56] also radially surrounds threaded retainer [54], abuts compression gasket [62], and provides a seal. When pothead connector [22] is connected to downhole electric motor [16] (FIG. 1), compression gasket [62] expands radially outward, providing additional sealing protection. Finally, terminal pin isolation seal [64] radially surrounds prong receptacle insulator [55].

Figure 5:
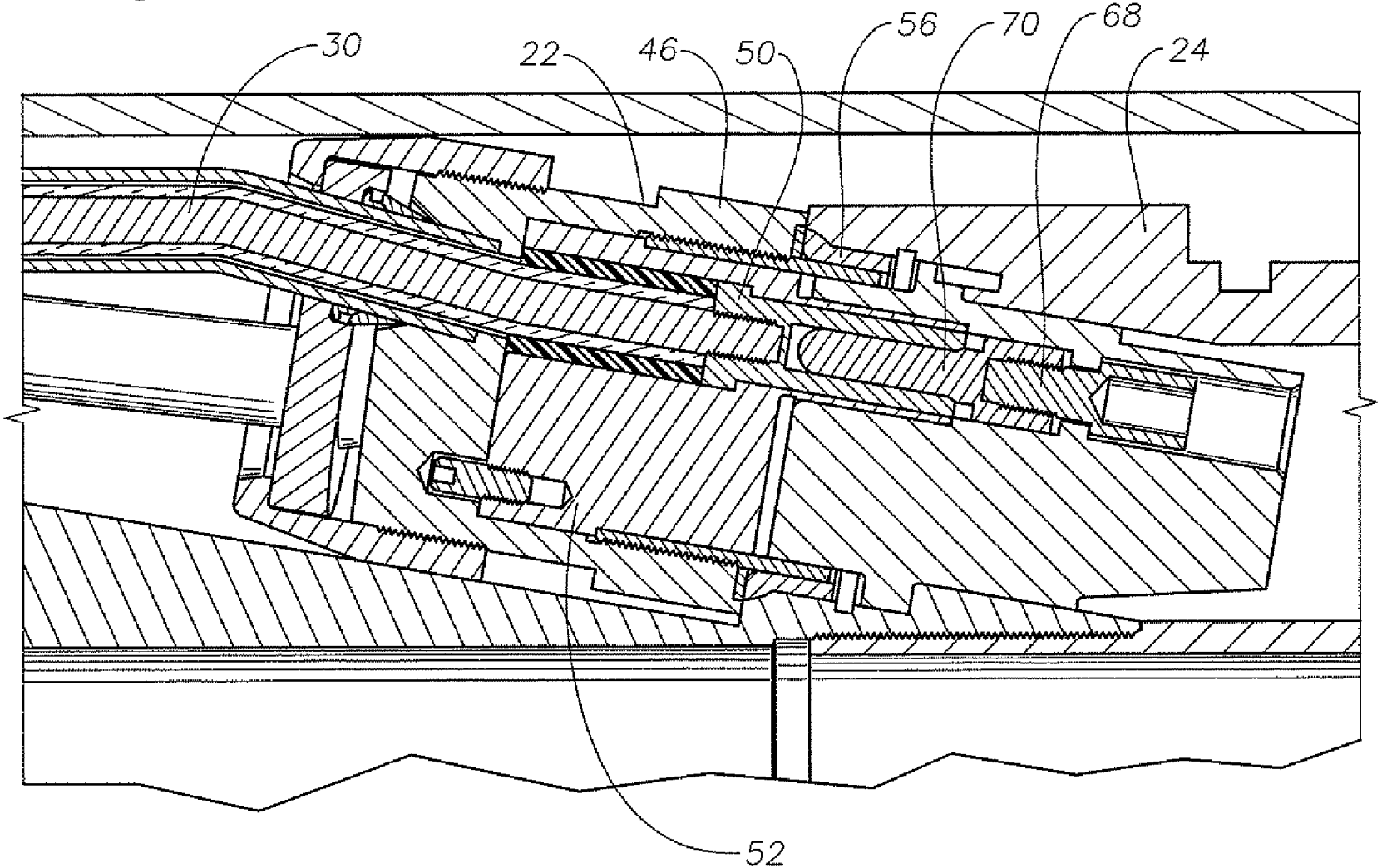
FIG. 5 is a longitudinal cross sectional view showing the connection between the pothead connector and housing.

FIG. 5 is a longitudinal cross sectional view showing the connection between pothead connector [22] and motor housing [24]. In the embodiment shown, female receptacle [50] of pothead connector [22] connects to motor housing [24] via male terminal [70]. Motor lead terminal [68] connects with male terminal [70] to provide the electrical connection to motor.

While the invention has been shown or described in only some of its forms, it should be apparent to those skilled in the art that it is not so limited, but is susceptible to various changes without departing from the scope of the invention. Additionally, the present invention may suitably comprise, consist or consist essentially of the elements disclosed and may be practiced in the absence of an element not disclosed.

What is claimed is:

1. A pothead assembly comprising:

a compression plate having a plurality of holes therethrough, each hole adapted to receive a metal wire protector containing an insulated wire;

a plurality of metal ferrules, wherein each ferrule surrounds one of the metal wire protectors and engages one of the holes of the compression plate;

a pothead housing having a base portion containing a plurality of base passages formed therein that register with the holes in the compression plate, wherein each passage receives one of the insulated wires; and a single compression collar in operable engagement with the pothead housing and all of the ferrules, with the compression plate located between at least a portion of the compression collar and the base portion such that advancing the compression collar toward the base portion compresses each ferrule such that each ferrule is operable to circumferentially engage and seal around one of the metal wire protectors.

2. The pothead assembly of claim 1, wherein the compression plate's plurality of holes are located radially about the compression plate's centerpoint.

3. The pothead assembly of claim 1, wherein the compression plate comprises a lower face and the base portion of the pothead housing comprises backside face, wherein one of the faces is generally convex and the other face is generally concave.

4. The pothead assembly of claim 1, wherein the ferrules are compressed simultaneously.

5. The pothead assembly of claim 1, further comprising:

a lower insulator having a lower end and an upper end, the upper end having a plurality of insulator passages formed therein, wherein the insulator passages are aligned with the base passages, the lower end having a plurality of prong receptacle insulators;

a plurality of female receptacles partially disposed within the insulator passages;

a plurality of retaining sleeves disposed within the insulator passages, and wherein the retaining sleeves abut the female receptacles;

a retainer having a back portion that is operable to threadedly engage the pothead housing;

a compression gasket radially surrounding the retainer, wherein the compression gasket contacts the pothead housing, and wherein the compression gasket is operable to expand radially outward when the pothead assembly is connected to a downhole electric motor;

a boot radially surrounding the retainer and abutting the compression gasket, wherein the boot is operable to provide additional sealing protection; and a terminal pin isolation seal radially surrounding the prong receptacle insulators.

6. The pothead assembly of claim 1, further comprising:

a lower insulator having a plurality of insulator passages formed therein, wherein the insulator passages are aligned with the base passages, the lower end having a plurality of prong receptacle insulators;

a plurality of female receptacles partially disposed within the insulator passages;

a plurality of retaining sleeves disposed within the insulator passages, and wherein the retaining sleeves abut the female receptacles; and a retainer having a back portion that is operable to threadedly engage the pothead housing.

7. The pothead assembly of claim 6, further comprising:

a first alignment bore formed forward from the lower insulator's back surface;

a second alignment bore formed backward from the base portion's front surface;

an indexing pin, the indexing pin disposed within the first alignment bore and the second alignment bore, the indexing pin operable to properly align components within the pothead assembly.

8. The pothead assembly of claim 6, wherein the retainer is made of a non-conductive material.

9. The pothead assembly of claim 6, wherein the retainer is made of polyetheretherketone.

10. The pothead assembly of claim 6, wherein the retainer further comprises a recess on a front edge of the retainer, wherein the recess is formed to cooperate with a tool, the tool operable to apply the necessary torque to engage the retainer with the pothead housing.

11. A pothead assembly comprising:

a compression plate having a lower face and a plurality of holes therethough, each of the holes being operable to receive an insulated wire contained within a metal wire protector, wherein said plurality of holes are spaced circumferentially about a center of the compression plate;

a plurality of conical metal ferrules, each being operable to receive one of the metal wire protectors therethrough;

a pothead housing, the pothead housing having a lower end and an upper end, the lower end comprising a flange and being operable to engage a downhole electric motor, the upper end comprising a base portion and a backside face the base portion and the backside face having a plurality of passages formed therethough, each of the passages operable to receive one of the ferrules and one of the insulated wires; and a compression collar having an axis, the compression collar being engageable with the pothead housing, wherein the compression plate is located therebetween; and wherein each of the passages in the backside face has a conical portion that mates with one of the ferrules, such that when the compression collar is engaged with the upper end of the pothead housing, the compression collar exerts an axial force on the compression plate, causing the compression plate to exert an axial force on the ferrules, which causes the ferrules to move inwardly into the conical portions of the passages of the backside face and deform circumferentially about the metal wire protectors to form a metal to metal seal.

12. The pothead assembly of claim 11, wherein the seal is formed around each metal wire protector without the use of a weld joint or a solder joint.

13. The pothead assembly of claim 11, wherein a portion of an inner periphery of the compression collar is threaded for engaging threads of the pothead housing, and an upper end of the compression collar includes an annular lip, the annular lip being operable to exert an axial force on the compression plate as the threads are tightened.

14. The pothead assembly of claim 13, further comprising a portion of the upper end of the pothead housing having threads on an outer periphery that engage the threads of the inner periphery of the compression collar, wherein the plurality of passages are spaced complimentarily to the plurality of holes of the compression plate.

15. The pothead assembly of claim 11, wherein one of the faces of the pothead housing and the compression plate is generally convex and the other face is generally concave.

16. The pothead assembly of claim 11, wherein the ferrules have conical exterior portions.

17. The pothead assembly of claim 11, further comprising:

a plurality of base passages formed within the base portion of the pothead housing;

a lower insulator having a lower end and an upper end, the upper end having a plurality of insulator passages formed therein, wherein the insulator passages are aligned with the base passages, the lower end having a plurality of prong receptacle insulators;

a plurality of female receptacles, wherein the female receptacles are partially disposed within the insulator passages;

a plurality of retaining sleeves, wherein the retaining sleeves are disposed within the insulator passages, and wherein the retaining sleeves abut the female receptacles; and a retainer having a back portion that is operable to threadedly engage a housing skirt of the pothead housing.

18. The pothead assembly of claim 17, further comprising:

a first alignment bore formed forward from the lower insulator's the back surface;

a second alignment bore formed backward from the base portion's front surface;

an indexing pin, the indexing pin disposed within the first alignment bore and the second alignment bore, the indexing pin operable to properly align components within the pothead assembly.

19. The pothead assembly of claim 17, wherein the retainer further comprises a recess on a front edge of the retainer, wherein the recess is formed to cooperate with a tool, the tool operable to apply the necessary torque to engage the retainer with the pothead housing.

20. A method of creating a metal to metal seal within a pothead without the use of a weld joint, the method comprising:

inserting a plurality of metal wire protectors through a plurality of passages of a pothead assembly, wherein each metal wire protector contains an insulated wire, wherein the pothead assembly comprises:

a compression plate having the plurality of holes therethrough, each hole adapted to receiving one of the metal wire protectors;

a plurality of ferrules, wherein each ferrule surrounds one of the metal wire protectors and engages one of the holes of the compression plate;

a pothead housing having a base portion containing a plurality of base passages formed therein that register with the holes in the compression plate, wherein each passage receives one of the wire protectors; and a single compression collar that engages the pothead housing and all of the ferrules, with the compression plate located between at least a portion of the compression collar and the base portion; and moving the single compression collar toward the pothead housing such that the compression plate exerts a compressive force on the ferrules against the pothead housing, and simultaneously compresses all the ferrules about the metal wire protectors to form a metal to metal seal.

* * * * *